United States Patent [19]

Murata et al.

[11] 4,444,386

[45] Apr. 24, 1984

[54] CASSETTE CASING WITH PIVOTING SHEET STOPS FOR AN ELECTROSTATIC COPYING APPARATUS

[75] Inventors: Naoaki Murata, Takarazuka; Masahiro Yoshioka, Matsubara; Kiyoshi Hayashi, Takatsuki; Yasusuke Tohi, Sakai, all of Japan

[73] Assignee: Mita Industrial Co., Ltd., Osaka, Japan

[21] Appl. No.: 296,055

[22] Filed: Aug. 25, 1981

Related U.S. Application Data

[62] Division of Ser. No. 99,720, Dec. 3, 1979, Pat. No. 4,325,626.

[30] Foreign Application Priority Data

| | | | |
|---|---|---|---|
| Dec. 13, 1978 | [JP] | Japan | 53-153203 |
| Feb. 2, 1979 | [JP] | Japan | 54-10304 |
| Mar. 29, 1979 | [JP] | Japan | 54-41643[U] |
| Apr. 5, 1979 | [JP] | Japan | 54-40302 |
| Apr. 14, 1979 | [JP] | Japan | 54-44877 |
| May 25, 1979 | [JP] | Japan | 54-70992[U] |
| May 25, 1979 | [JP] | Japan | 54-70993[U] |
| May 25, 1979 | [JP] | Japan | 54-70994[U] |
| May 25, 1979 | [JP] | Japan | 54-70995[U] |

[51] Int. Cl.[3] ..... B65H 1/12

[52] U.S. Cl. ..... 271/127; 271/171; 271/223; 206/449

[58] Field of Search ..... 271/126, 127, 160, 164, 271/171, 223; 221/242; 206/449

[56] References Cited

U.S. PATENT DOCUMENTS

| | | | |
|---|---|---|---|
| 77,527 | 5/1868 | Reed | 271/226 |
| 1,974,469 | 9/1934 | Roberts | 271/171 |
| 4,032,136 | 6/1977 | Komaba et al. | 271/171 |

*Primary Examiner*—Bruce H. Stoner, Jr.
*Assistant Examiner*—James E. Barlow
*Attorney, Agent, or Firm*—Wenderoth, Lind & Ponack

[57] ABSTRACT

An electrostatic copying apparatus in which the paper is fed from a cassette. The cassette has a casing for a stack of sheet-like copying papers of at least two different sizes, said casing being a box-like housing having an open top, a closure plate mounted detachably on the top surface of the housing and having at least one display window, and at least two restricting members mounted in spaced-apart relation in the longitudinal direction of the cassette casing so that they can pivot about the axial line of the cassette casing extending in the transverse direction of the cassette casing, each of the restricting members having a restricting portion for restricting the rear end of copying papers to be accommodated in the housing and a display portion having an indication of the size of copying papers, the display portion being positioned adjacent to the display window when the restricting portion is brought to its operative position beneath the closure plate.

5 Claims, 17 Drawing Figures

FIG. 2-A
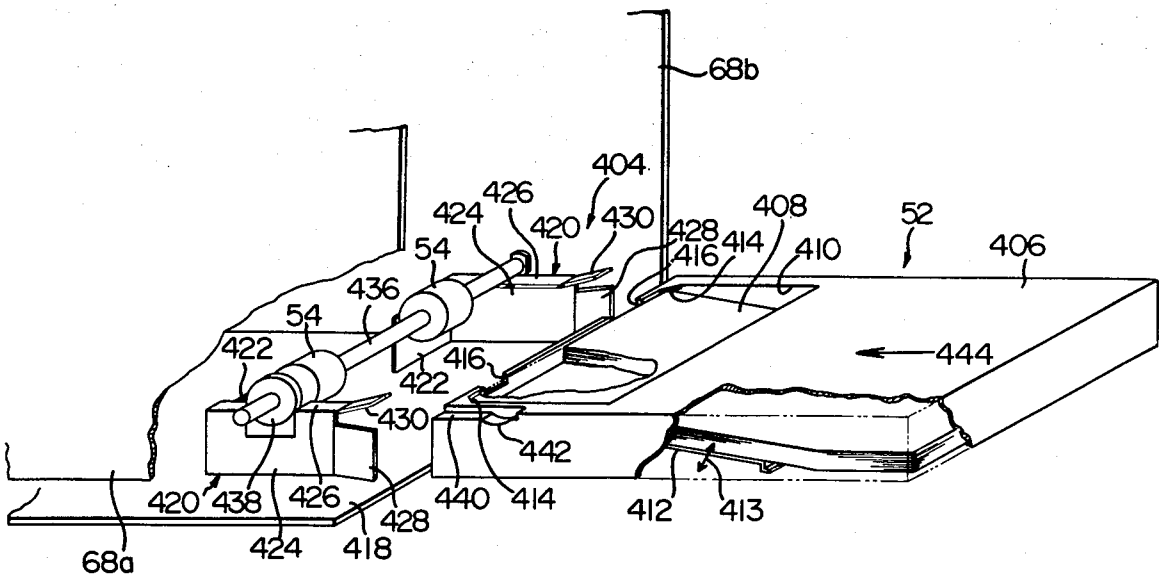

FIG. 2-B
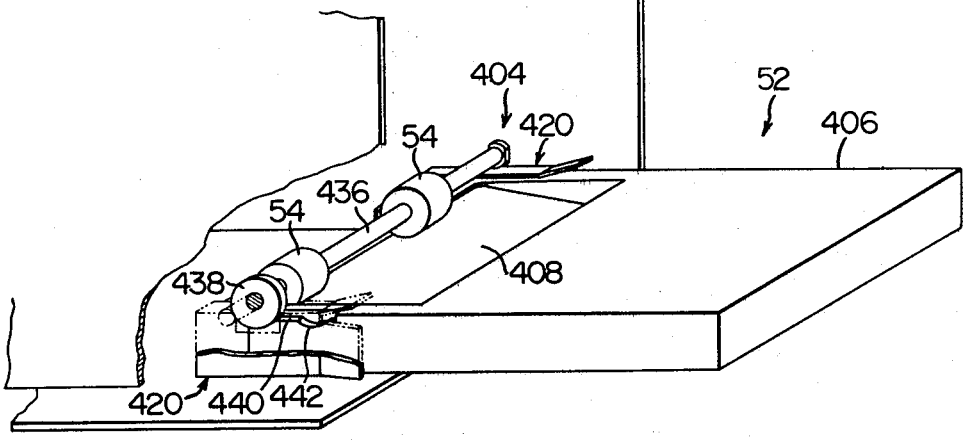
FIG. 2-C
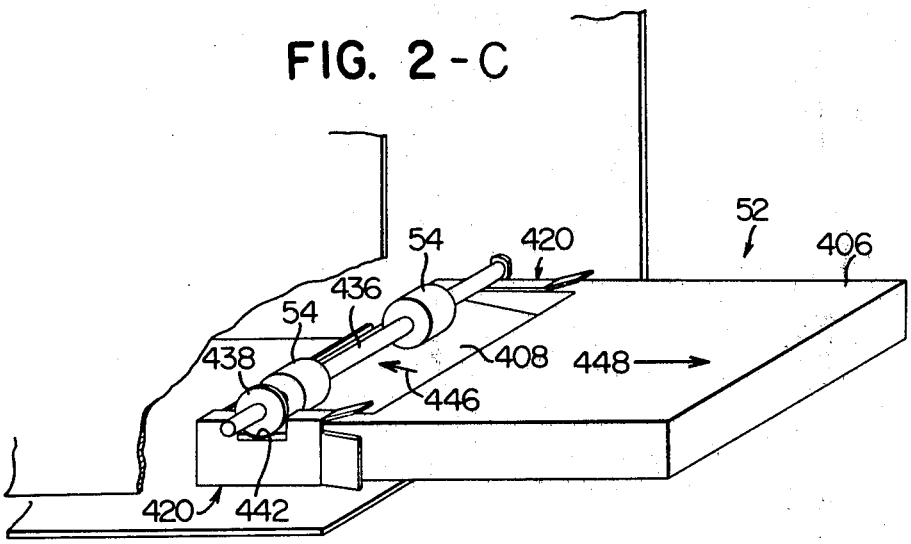

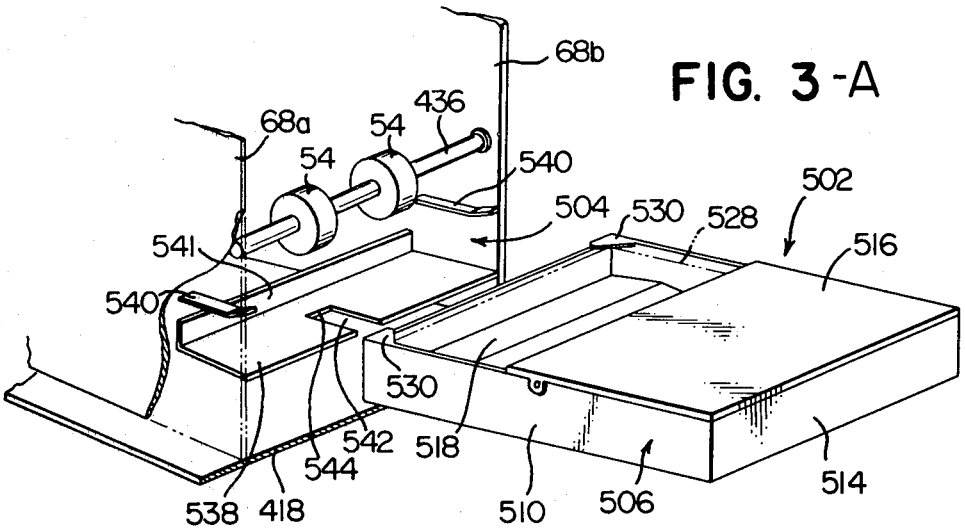
FIG. 3-A
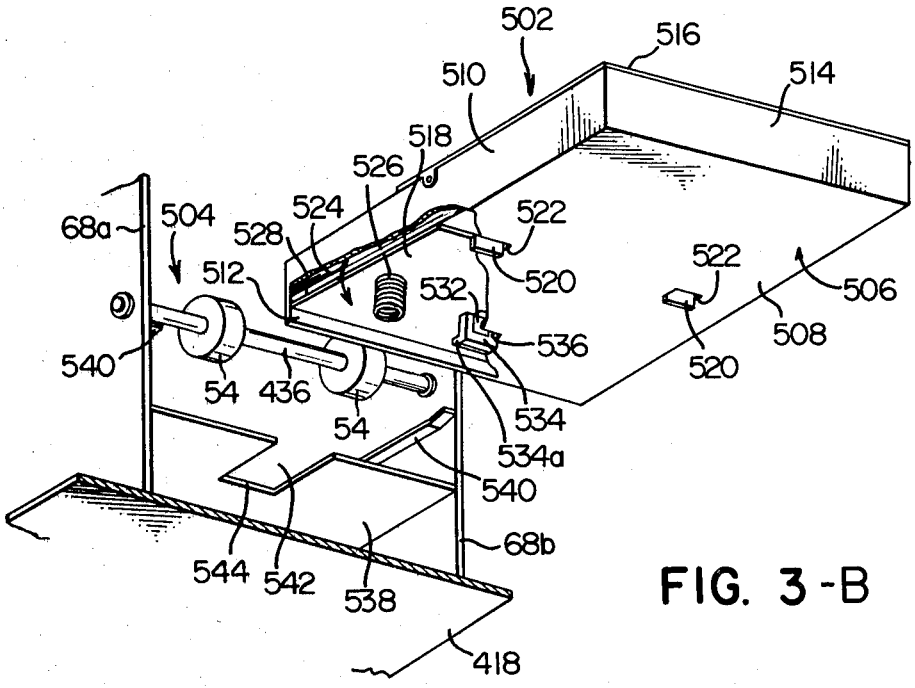
FIG. 3-B

FIG. 4-A
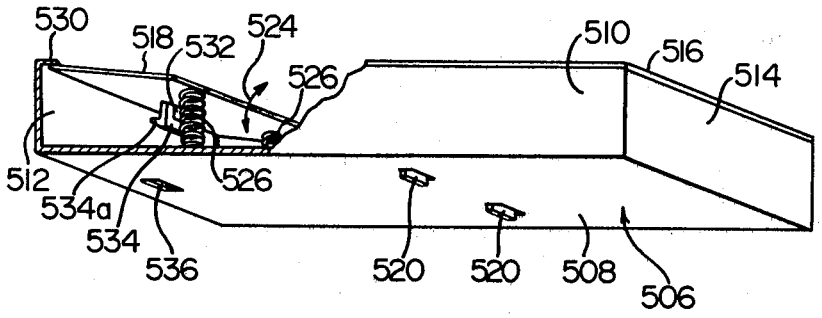
FIG. 4-B
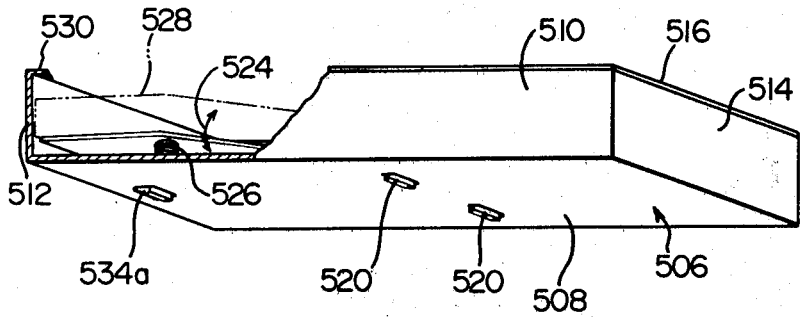

FIG. 5-A
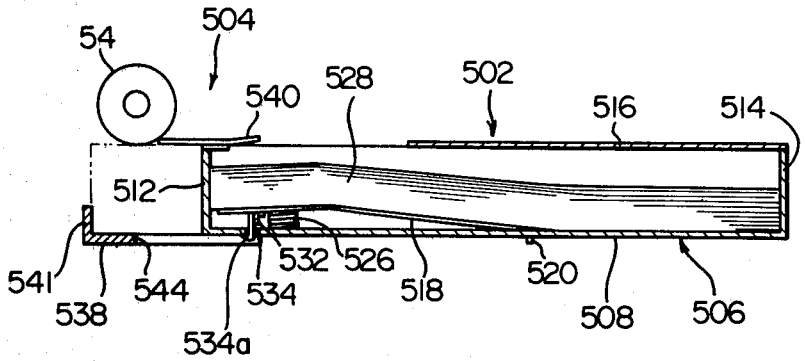
FIG. 5-B
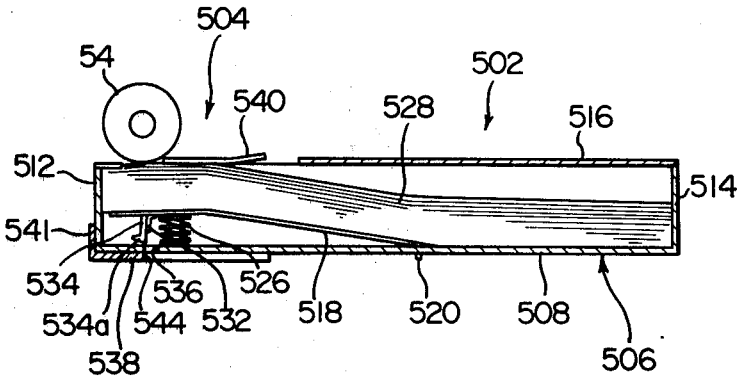

FIG. 10-A
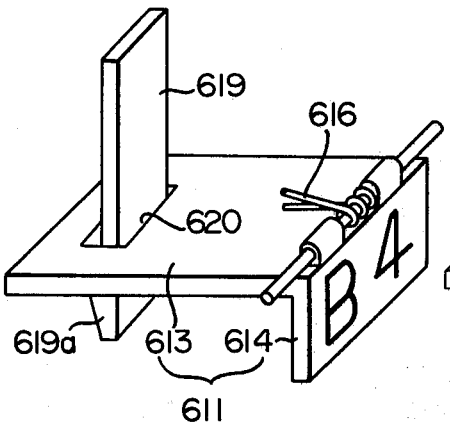
FIG. 10-B
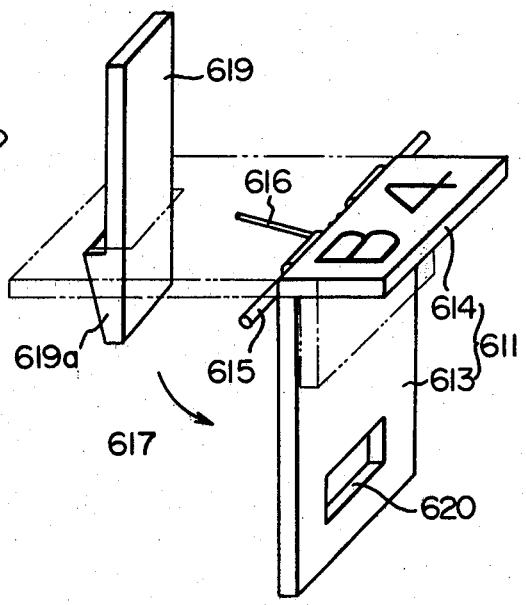
FIG. 11
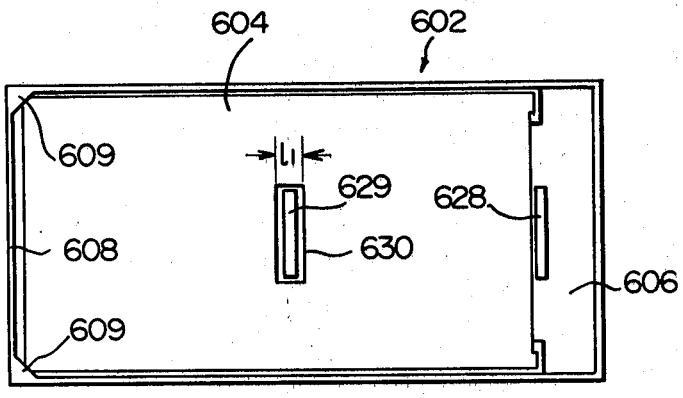

CASSETTE CASING WITH PIVOTING SHEET STOPS FOR AN ELECTROSTATIC COPYING APPARATUS

This application is a divisional application of Ser. No. 099,720 filed Dec. 3, 1979, now U.S. Pat. No. 4,325,626.

FIELD OF THE INVENTION

This invention relates to an electrostatic copying apparatus, particularly an electrostatic copying apparatus of the type in which a rotary drum having a photosensitive member on its surface is rotatably and removably disposed within a housing and which has a paper feeding cassette.

DESCRIPTION OF THE PRIOR ART

In an electrostatic copying apparatus equipped with a rotary drum having a photosensitive member on its surface, there is generally practiced a transfer-type electrostatic copying process which involves forming on the photosensitive member a latent electrostatic image corresponding to a pattern of an original, optionally developing the latent image, and thereafter transferring the latent electrostatic image or optionally the developed image on the photosensitive member to a copying sheet. It is well known to those skilled in the art that in such an electrostatic copying apparatus, the rotary drum having a photosensitive member on its surface needs to be mounted rotatably and removably at a predetermined site within a housing of the apparatus in order to easily remove paper jamming that may occur around the rotary drum or to exchange or clean the photosensitive member as required. Thus, conventional electrostatic copying apparatuses are so constructed that the rotary drum can be mounted and detached by moving it in the direction of its central axial line of rotation.

Electrostatic copying apparatuses of the known type described above also have problems or defects which must be solved or remedied in various respects such as the construction of a paper feeding cassette for feeding copying sheets.

SUMMARY OF THE INVENTION

It is a primary object of this invention to provide a novel and excellent paper feeding cassette for an electrostatic copying apparatus.

According to this invention, there is provided, as a paper feeding cassette which achieves the aforesaid primary object, a cassette casing comprising: a rectangular box-like housing having a longitudinal axis and an open top; a closure plate detachably mounted on the top of said housing and having at least one display window therein; and at least two sheet stop members mounted on the underside of said closure plate in spaced apart relation in the direction of the longitudinal axis of said cassette casing for pivotal movement about an axis extending transversely to said longitudinal axis, each of said sheet stop members having a sheet stop portion which, when said sheet stop member is pivoted to a sheet restricting position extends downwardly into said housing for restricting the position of the rear end of copying papers accommodated in said housing, and a display portion having an indication of the size of copying papers thus restricted, said display portion being positioned adjacent said display window when said stop portion is pivoted to its sheet restricting position.

BRIEF DESCRIPTION OF THE DRAWINGS

FIGS. 2-A to 2-C are partial perspective views showing a cassette-type paper feed means in one embodiment of the electrostatic copying apparatus in accordance with this invention;

FIGS. 3-A and 3-B are partial perspective views showing a second embodiment of the cassette-type paper feed means;

FIGS. 4-A and 4-B are perspective views of a copying paper cassette used in the cassette-type paper feed means shown in FIGS. 3-A and 3-B;

FIGS. 5-A and 5-B are sectional views of the cassette-type paper feed means shown in FIGS. 3-A and 3-B;

FIGS. 10-A and 10-B are prespective views of a restricting member; and

FIG. 11 is a top plan view of a main body of a cassette casing.

DETAILED DESCRIPTION OF PREFERRED EMBODIMENTS

The invention is described below in detail with reference to the accompanying drawings.

Outline of the general structure of the apparatus

Figure 1:
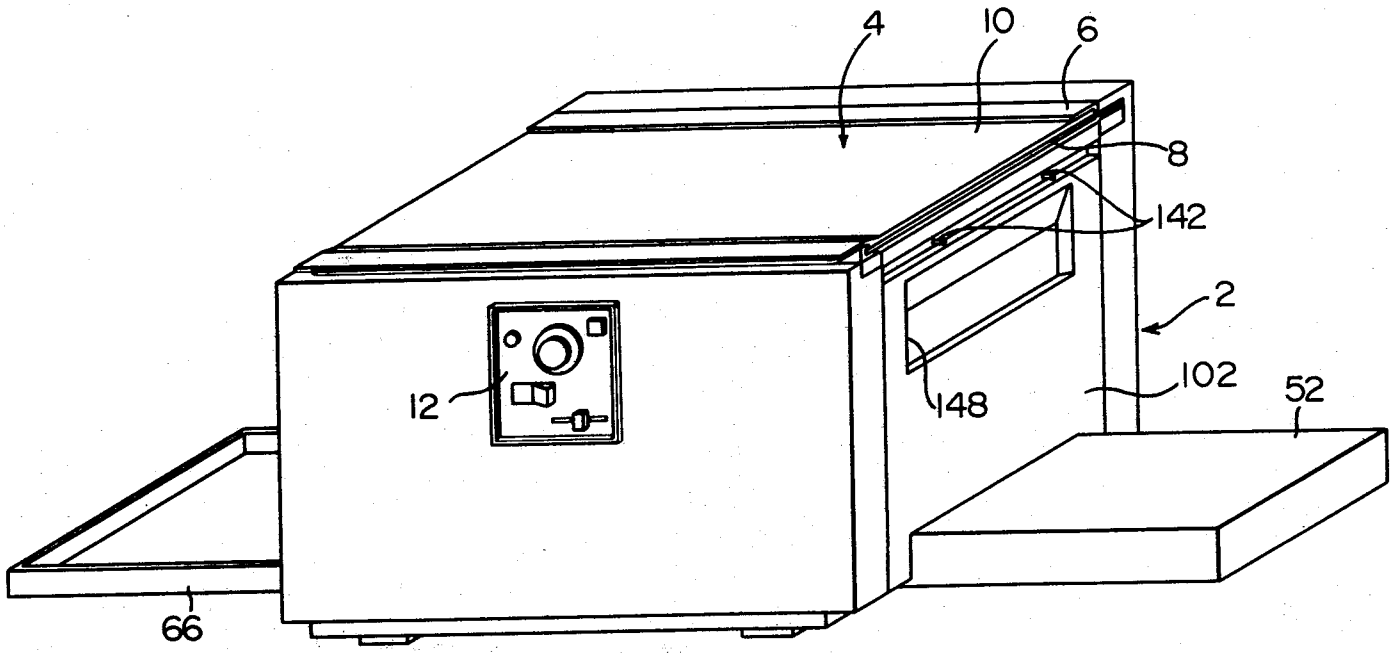
FIG. 1 is a perspective view showing one embodiment of the electrostatic copying apparatus in accordance with this invention.

Referring to FIG. 1, the general structure of the illustrated electrostatic copying apparatus is first described.

The electrostatic copying apparatus shown in the drawings has a substantially rectangular parallelpipedal housing generally shown at 2. On the top surface portion of the housing 2 is disposed an original-support means 4 for supporting an original to be copied. The original-support means 4 in the illustrated embodiment consists of a support frame 6 mounted so that it can move in the direction of scanning the original (in the transverse direction in FIG. 1) by a suitable method, a transparent plate 8 secured to the support frame 6 for placing thereon the original to be copied, and an original-holding member 10 having one edge (top edge in FIG. 1) connected to the support frame 6 and capable of being brought to a condition in which it covers the original placed on the transparent plate 8 (the condition shown in FIG. 1). In the copying process, the original support means 4 is moved in the right or left direction in FIG. 1 by a suitable drive means (not shown). A control panel 12 having a control switch, etc. is disposed on the front surface portion of the housing 2.

An electrostatic copying apparatus requires a paper feed means for properly feeding a copying paper (i.e. a receptor sheet for transfer thereto of a latent image corresponding to an original or a developed image, or a photosensitive paper for forming an image corresponding to the original directly thereon). In modern electrostatic copier machines, it is the widespread practice to use a cassette-type paper feeding means in which a copying paper cassette is directly introduced into the housing, as is the case with the apparatus shown in FIG. 1. In such a cassette-type paper feeding means, the cassette generally consists of a box-like cassette casing with its top surface at least partly opened and a plurality of copying paper sheets of a predetermined size stacked within the casing. The stack of copying paper sheets is urged upwardly by the action of a spring. In the housing of the apparatus, a cassette-receiving section for the cassette is provided. Within the cassette-receiving section are disposed paper feed rollers which come into engagement with copying sheets within the cassette through its top opening, more specifically the uppermost sheet of the stack of copying paper sheets, and thereby can deliver the copying paper sheets within the cassette one by one.

In the cassette-type paper feeding means described above, it is generally necessary that the paper feed rollers should come into engagement with a copying paper in the cassette only when the cassette is inserted into a predetermined position. The paper is in the cassette when the cassette is inserted into or taken out of the housing for loading or exchange of copying papers. If the paper feed rollers come into engagement with a copying paper in the cassette at the time of inserting or removing the cassette, the paper feed rollers would obstruct the movement of the uppermost copying paper, and thereby, the uppermost copying paper would get wrinkled or come out of the cassette.

As disclosed in Japanese-Laid-Open Patent Publication No. 18337/74, in a conventional electrostatic copying apparatus equipped with the aforesaid cassette-type paper feeding means, the paper feed rollers are mounted so as to be movable up and down and are urged by a spring to a lower operative position, so that at the time of inserting a paper cassette, the paper feed rollers move upwardly against the resistance of the urging action of a spring by the action of cooperative cam means (a cam plate and a dovetail) provided at the cassette casing and the cassette-receiving section of the housing, and at the time of removing the cassette from the housing, the paper feed rollers move upwardly against the resistance of the urging action of a spring by a manual operation of a manually operable member (handle) provided in the cassette casing. Thus, at the time of inserting or removing the paper cassette, the paper feed rollers are moved upward from the operative position, and therefore, do not come into engagement with a copying paper. When the cassette is inserted into a predetermined position, the paper feed rollers are returned to the operative position by the urging action of a spring and engage the copying paper.

In another embodiment shown in Japanese Laid-Open Patent Publication No. 18336/74, instead of moving the paper feed rollers upwardly from the operative position at the time of inserting or removing the paper cassette, the paper feed means is constructed such that a stack of copying papers urged upwardly by the action of a spring within the cassette casing are moved downwardly against the resistance of the urging action of the spring by the action of cooperative cam means (a dovetail and a cam plate) provided at the cassette casing and the cassette-receiving section of the housing, and at the time of removing the cassette, the copying papers are moved downwardly against the resistance of the action of the spring by manually operating a manually operable member (handle) provided in the cassette casing. Thus, at the time of inserting or removing the cassette, copying papers within the cassette are moved downwardly from their normal position, and therefore, the paper feed rollers do not make contact with the copying papers. When the cassette is inserted into a predetermined position, the copying papers are returned to the normal position within the cassette by the urging action of the spring, and the paper feed rollers engage the copying paper.

The conventional electrostatic copying machines described above have the following defects.

(1) The paper feeding means is complicated and expensive because of the need for the provision of cooperative cam means at the cassette casing and the cassette-receiving section of the housing and also for the provision of a manually operable member in the cassette casing.

(2) The operation required for removing the cassette from the apparatus is complicated because the manually operable member must be operated prior to the removal of the cassette.

In contrast, the electrostatic copying apparatus described herein is improved such that the wrinkling of copying paper and its displacement from the cassette can be completely prevented at the time of inserting or removing the cassette without the need for any means of keeping the paper feed rollers out of engagement with the copying paper, a complicated and expensive means such as cam means and manually operable member, and also for a complicated operation.

A first embodiment of the cassette-type paper feeding means which achieves the aforesaid improvement is described in detail with reference to FIGS. 2-A, 2-B and 2-C.

Referring to FIG. 2-A, the illustrated electrostatic copying apparatus is provided with a cassette-type paper feeding means including a copying paper cassette 52 and a cassette-receiving section 404 formed in the housing of the apparatus.

The paper cassette 52 includes a generally boxlike cassette casing 406 and a plurality of sheet-like copying papers 408 accommodated in the casing 406 in the stacked state. An opening 410 is formed on at least a part of the top surface (the forward portion of the top surface in the illustrated embodiment) of the cassette casing 406. The front portion of the copying papers 408 is exposed through the opening 410. Preferably, a bottom plate 412 is provided at the bottom of the cassette casing 406 to urge the copying paper 408 upwardly. In the illustrated embodiment, the bottom plate 412 extends from its rear end located somewhat rearwardly of an intermediate portion of the cassette casing 406 in its longitudinal direction (in the left and right direction in FIG. 2-A) to a point near the front end of the cassette casing 406. The bottom plate 412 is disposed pivotally about its rear end in the direction shown by an arrow 413. Between a bottom wall defining the bottom surface of the cassette casing 406 and the bottom plate 412 is provided a spring (not shown) urging the bottom plate 412 clockwise in FIG 2-A. The front portion of the stack of copying papers 408 accommodated in the cassette casing 406 is placed on the bottom plate 412, and therefore, elastically urged upwardly by the elastic action of the aforesaid spring which acts via the bottom plate 412. On the other hand, a pair of press members 414 for restricting the upward movement of the copying papers 408 upon engagement with both sides of the front end of the copying papers 408 are provided at both side portions of the front end of the top surface of the cassette casing 406. Thus, irrespective of the number of copying papers 408 in the cassette casing 406, the front portion of a copying paper located topmost is always maintained in a certain relation to the top surface of the cassette casing 406 by the cooperation of the bottom plate 412 and the spring (not shown) with the press member 414. A pair of cuts 416 are provided in the upper edge portion of the front end wall of the cassette casing 406.

The cassette-receiving section 404 formed in the housing of the apparatus is constructed of a horizontal plate member 418 defining the bottom wall of the apparatus and a pair of guide members 420 spaced from each other on the plate member 418. Each of the guide members 420 has a front wall portion 422 which when the cassette 52 is inserted into a predetermined position through an opening formed on one end wall (not shown) of the apparatus, abuts the front end wall of the cassette casing 406 and thus obstructs further insertion of cassette 52, a side wall portion 424 which restrict the lateral movement of the cassette 52, and a top wall portion 426 which restricts the upward movement of the cassette 52. The distance in the lateral direction between the side wall portions 424 of the guide members 420 corresponds substantially to the width of the cassette casing 406. The distance in the perpendicular direction between the plate member 418 and the top wall portion 426 of each of the guide members 420 corresponds substantially to the height of the cassette casing 406. Also, at the rear end portion of each of the guide members 420 are provided a guide wall portion 428 for guiding the cassette in the lateral direction which is inclined lateral outwardly toward the rear and a guide wall portion 430 for guiding the cassette in the perpendicular direction which is inclined upwardly toward the rear in order to make it easy to insert the cassette 52 between the guide members 420 and position it as prescribed.

The cassette-type paper feeding means further has paper feed rollers 54 provided in the cassette-receiving section 404. In the illustrated embodiment, the support shaft 436 is rotatably mounted between a pair of inner side plates **68*a* and 68*b* spaced from each other in the lateral direction, and a pair of feed rollers 54 are secured in a spaced-apart relationship to the support shaft 436**.

The aforesaid construction of the cassette-type paper-feeding means provided in the illustrated electro-static copying apparatus is known. In the disclosed apparatus, the following novel improvements have been made in the cassette-type paper feeding means described above.

Specifically, an auxiliary roller connected operatively to the paper feed roller 54 is provided in the cassette-receiving section 404, and at the front end portion of the cassette casing 406, an actuating portion is provided which when the cassette 52 is inserted into, or removed from, the cassette-receiving section 404, engages the auxiliary roller to rotate it.

In the illustrated embodiment, an auxiliary roller 438 having substantially the same outside diameter as the outside diameter of the paper feed roller 54 is secured to one end portion of the shaft 436 having a pair of paper feed rollers 54 secured thereto. In one of the guide members 420, the top wall portion 426 and the side wall portion 424 are partly cut so as to secure a space for the provision of the auxiliary roller 438. On the other hand, in the cassette casing 406, a part (i.e., the outside portion) of the front end portion of its one side wall is slightly lower than the other part, and an actuating section 440 is formed on the top surface of this part which is substantially flat and horizontal. An arcuate recess 442 is provided immediately rearwardly of the aforesaid top surface which constitutes the actuating section 440.

The operation and advantage of the electrostatic copying apparatus of this invention which has been improved in the aforesaid manner in the cassette-type paper feeding means are described with reference to FIGS. 2-B and 2-C together with FIG. 2-A

When the cassette 52 is moved from the position shown in FIG. 2-A in a direction shown by an arrow 444 in FIG. 19-A and inserted into the cassette-receiving section 404 defined by the guide members 420 and the plate member 418, the cuts 416 provided in the front end wall of the cassette casing 406 respectively receive the paper feed rollers, and the undersurfaces of the paper feed rollers 54 engage the top surface of the uppermost copying paper of the stack of copying papers 408 in the cassette casing 406 through the opening 410 formed on the top surface of the casing 406, as shown in FIG. 2-B. When during this inserting operation, the cassette 52 is introduced to a position at which the cuts 416 match the paper feed rollers 54 (i.e. immediately before the paper feed rollers 54 engage the copying paper 408), the actuating section 440 formed at the front end portion of one side wall of the cassette casing 406 abuts the lower surface of the auxiliary roller 438 and is engaged therewith. Hence, when the cassette 52 is moved in the direction shown by arrow 444 in FIG. 2-A, the auxiliary roller 438 is positively rotated clockwise in FIG. 2-A and FIG. 2-B in response to the movement of the cassette 52, and thereby the shaft 436 and the paper feed rollers 54 are positively rotated clockwise in FIGS. 2-A and 2-B. When the cassette 52 is further inserted after the actuating section 440 abuts the auxiliary roller 438, the paper feed rollers 54 go beyond the cuts 416 and engage the copying paper 408. At this time, the paper feed rollers 54 are positively rotated clockwise in FIGS. 2-A and 2-B in response to the movement of the cassette 52 in the direction shown by arrow 444 in FIG. 2-A and therefore to the movement of the copying paper 408. Since the outside diameter of the auxiliary roller 438 is substantially equal to the outside diameter of the paper feed roller 54, the amount of rotation of the surfaces of the paper feed rollers 54 is substantially equal to the amount of movement of the cassette 52 in the direction of arrow 444 in FIG. 2-A, and therefore, to the amount of movement of the copying paper 408. Hence, when the paper feed rolls 54 engage copying paper 408 at the time of inserting cassette 52 into the cassette-receiving section 404, the movement of the copying paper 408 is not obstructed, and moreover, the topmost copying paper in the stack of copying papers 408 is not moved relative to the cassette casing, nor wrinkled.

In the absence of the actuating section 440 and the auxiliary roller 438 provided in accordance with this invention, the paper feed rollers 54 would not be positively rotated at the time of inserting the cassette 52 into the cassette-receiving section 404. Hence, after engagement of the paper feed rollers 54 with the copying paper 408, the movement of the copying paper 408 in the direction of arrow 444 in FIG. 2-A is hampered, and therefore, the topmost copying paper in the copying papers 408 is moved relative to the cassette casing 406 or wrinkled. Or when the rear end surface of the cassette casing 406 is not completely closed, the copying paper may drop off from the rear end surface of the cassette casing 406.

Since the support shaft 436 having paper feed rollers 54 fixed thereto is mounted so that it rotates freely, when a copying paper engages the paper feed rollers 54, the paper feed rollers 54 tend to be rotated slightly by the movement of the copying paper caused by the insertion of the cassette 52. It will be readily appreciated however that since a force above a certain limit is required to rotate the support shaft 436 and the paper feed rollers 54 and the copying paper is generally very pliable, there is a greater tendency toward the obstruction of the movement of the topmost copying paper of the stack of copying papers 408 then toward the rotation of the paper feed rollers 54.

When the cassette 52 has been inserted into a predetermined position of the cassette-receiving section 404, i.e. a position at which the front end wall of the cassette casing 406 abuts the front wall portions 422 of the guide members 420, the auxiliary roller 438 moves away from the actuating section 440 and is positioned opposite to a recess 442, as shown in FIG. 2-C. Thus, the auxiliary roller 438 departs from the cassette casing 406 and is out of engagement or contact with any part of the cassette casing 406, so that it can rotate freely independently of the cassette casing 406. On the other hand, the paper feed rollers 54 are kept engaged with the topmost copying paper in the stack of copying papers 408. Thus, when the support shaft 436, and the paper feed rollers 54 are rotated clockwise in FIG. 2-C by suitable means such as the synchronously driving mechanism described hereinabove with reference to FIGS. 15 to 18, the topmost copying paper 408 is delivered from the cassette casing 406 in the direction shown by an arrow 446 in FIG. 2-C.

Now, the removal of the cassette 52 from the cassette-receiving section 404 for change of copying papers or otherwise is described in detail. To remove the cassette 52 from the cassette-receiving section 404, the cassette 52 is moved in the direction shown by an arrow 448 in FIG. 2-C, whereupon the actuating section 440 of the cassette casing 406 immediately engages the auxiliary roller 438. Thus, the auxiliary roller 438 is rotated counterclockwise in FIG. 2-C in response to the movement of the cassette 52 in the direction of arrow 448 in FIG. 2-C, and therefore, the support shaft 436 and the paper feed rollers 54 are rotated counterclockwise in FIG. 2-C. The engagement of the actuating section 440 with the auxiliary roller 438 is maintained until the cassette 52 is moved in the direction of arrow 448 in FIG. 2-C and the cuts 416 formed at the front end wall of the cassette casing 406 match in position with the paper feed rollers 54 (i.e. until immediately after the paper feed rollers 54 come out of engagement with the stack of copying papers 408 in the casing 406). Accordingly, until this time, the paper feed rollers 54 are positively rotated counterclockwise in FIG. 2-C in response to the movement of the cassette 52 in the direction of arrow 448 in FIG. 2-C. Thus, in the case of removing the cassette 52 as in the case of inserting it, the paper feed rollers 54 engage the copying papers 408, but the movement of the copying papers 408 is not hampered, and moreover, the topmost copying paper in the stack of copying papers 408 is not moved relative to the cassette casing 406 nor is it wrinkled nor does it drop off forwardly from the cassette casing 406.

In spite of the relatively simple and inexpensive improvement, the electrostatic copying apparatus can completely prevent wrinkling of the topmost copying paper in the stack of copying papers 408 in the cassette and its dropping from the cassette at the time of inserting or removing the cassette 52 into or from the cassette-receiving section 404. There is no need at this time for means for keeping the paper feed rollers 54 out of engagement with the copying papers 408, complicated and expensive special means such as the cam means and manually operable member disclosed in the specifications of Japanese Laid-Open Patent Publications Nos. 18337/74 and 18336/74, and for any complicated procedures such as the manual operation of the manually operable member other than a simple operation of moving the cassette 52 in the direction of arrow 444 in FIG. 2-A or in the direction of arrow 448 in FIG. 2-C.

While in the illustrated embodiment of the electrostatic copying paper, the auxiliary roller 438 is rotatably mounted coaxially with the paper feed rollers 54 by securing it to the support shaft 436 to which the paper feed rollers 54 are secured, it is possible to mount the auxiliary roller 438 rotatably at a suitable part of the cassette-receiving section 404 and drivingly connect it to the support shaft 436 and thus to the paper feed roller 54 by a suitable linking means such as a gear system. According to this modification, there is no need to make the outside diameter of the auxiliary roller 438 substantially equal to the outside diameter of the paper feed roller 54. Instead, for example, by properly selecting the number of teeth of the gear system constituting the linking system, the amount of movement of the cassette 52 can be made substantially equal to the amount of rotation of the surfaces of the paper feed rollers 54.

While in the illustrated embodiment, the actuating section 440 is provided in the front end portion of one side wall of the cassette casing 406, it is possible to provide the actuating section 440 at an arbitrary position at the front end portion of the cassette casing 406 according to the position of the auxiliary roller 438 disposed in the cassette-receiving section 404.

Furthermore, while in the illustrated embodiment, the amount of movement of the cassette 52 is made substantially equal to the amount of rotation of the surfaces of the paper feed roller 54 by making the outside diameter of the auxiliary roller 438 substantially equal to the outside diameter of the paper feed roller 54, some difference between the amount of movement of the cassette 52 and the amount of rotation of the surfaces of the paper feed rollers 54 will not cause any practical inconvenience if the amount of rotation of the surfaces of the paper feed rollers 54 is larger than the amount of movement of the cassette 52 at the time of inserting the cassette 52. For example, if the outside diameter of the auxiliary roller 438 is made smaller than the outside diameter of the paper feed roller 54, the surfaces of the paper feed rollers 54 are positively rotated clockwise in FIG. 2-A an amount slightly larger than the amount of movement of the cassette 52 in the direction of arrow 444 in FIG. 2-A by the cooperation of the actuating section 440 with the auxiliary roller 438 at the time of inserting the cassette 52 into the cassette-receiving section 404 by moving it in the direction of arrow 444 in FIG. 2-A. Accordingly, when the cassette 52 is inserted into the predetermined position shown in FIG. 2-C, the topmost copying paper in the stack of copying papers 408 is delivered to some extent in the direction of arrow 466 in FIG. 2-C by the delivering action of the paper feed rollers 54 which are positively rotated. But in an electrostatic copying apparatus of the type in which a delivered copying paper is stopped at a predetermined position in its conveying path and then again moved forward upon the starting of the scanning and exposure of the original, the early delivery of the copying paper at the time of inserting the cassette as described above does not cause any inconvenience. When the cassette 52 is to be removed from the cassette-receiving section 404, the surfaces of the paper feed rollers 54 are rotated counterclockwise in FIG. 2-C an amount slightly larger than the amount of movement of the cassette 52 in the direction of arrow 448 in FIG. 2-C. Thus, when the difference between the amount of movement of the cassette 52 and the amount of rotation of the surfaces of the paper feed rollers 54 is excessive, the topmost copying paper of the stack of copying papers 408 is positively driven rearwardly relative to the cassette casing 406, and therefore, likely to get wrinkled. If the outside diameter of the auxiliary roller 438 is made larger than that of the feed roller 54, the surfaces of the paper feed rollers 54 are rotated positively clockwise in FIG. 2-A only an amount smaller than the amount of movement of the cassette 52 at the time of inserting the cassette 52 into the cassette-receiving section 404 by moving it in the direction of arrow 444 in FIG. 2-A. Thus, when the difference between the amount of movement of the cassette 52 and the amount of rotation of the paper feed roller 54 is excessive, the movement of the topmost paper in the stack of copying papers 408 is excessively hampered, and the paper is likely to get wrinkled. When the cassette 52 is moved in the direction of arrow 448 in FIG. 2-C and removed from the cassette-receiving section 404, the surfaces of the paper feeding rollers 54 can be positively rotated counterclockwise in FIG. 2-C only a smaller amount than the amount of movement of the cassette 52. Accordingly, the topmost copying paper in the stack of copying papers 408 is displaced forward relative to the cassette casing 406 and projects slightly ahead of the cassette casing 406. So long as the amount of such projection is slight, however, there is no inconvenience such as the dropping of the copying paper from the cassette casing 406.

Second embodiment of the cassette-type paper feeding means

FIGS. 3-A and 3-B, FIGS. 4-A and 4-B and FIGS. 5-A and 5-B show a second embodiment of the cassette-type paper feeding means which can be used instead of the first embodiment described hereinabove.

Referring to FIGS. 3-A and 3-B and FIGS. 4-A and 4-B, the cassette-type paper feeding means is constructed of a copying paper cassette 502 and a cassette-receiving section 504 formed in the housing of the apparatus.

The cassette 502 has a generally box-like cassette casing 506. The casing 506 consists of a main body having a bottom wall 508, two side walls 510, a front wall 512 and a rear wall 514, and a closure plate 516 mounted detachably on the top surface of the main body. The closure plate 516 has its front end portion cut off, and therefore, the top surface of the front end portion of the cassette casing 506 is opened. On the bottom wall 508 of the cassette casing 506 is provided a bottom plate 518 at least the front end portion of which should be movable up and down. The bottom plate 518 in the illustrated embodiment extends from its rear end located slightly rearwardly of the intermediate point of the casing 506 in its longitudinal direction to a point near the front end of the casing 506. A pair of bending members 520 are formed at the rear end of the bottom plate 518. The bending members 520 are fitted in a pair of slots 522 formed at the bottom wall 508 of the casing 506. Accordingly, the bottom plate 518 is pivotable in the direction of an arrow 524 about its rear end, and by turning the bottom plate 518 in the direction of arrow 524, the front end portion of the bottom plate 518 is moved up and down. An elastic means formed of a spring 526 which urges the bottom plate 518 clockwise in FIG. 20-A is disposed between the bottom wall 508 and the bottom plate 518. Copying papers 528 in the stacked state can be easily placed within the casing 506 by removing the closure plate 516 from the main body of the cassette casing 506. The front portion of the stack of copying papers 528 is placed on the bottom plate 518, and therefore, elastically urged upwardly by the elastic action of the spring 526 which acts through the bottom plate 518. A pair of press members 530 adapted for engagement with both side portions of the front end of the copying papers 528 to restrict their upward movement are provided on both side portions of the front end of the top surface of the cassette casing 506. Thus, the front portion of the topmost copying paper in the copying papers 528 placed in the cassette casing 506 is maintained in a certain relation to the top surface of the cassette casing 506 irrespective of the number of copying papers in the stack.

The foresaid construction of the cassette 502 is known. According to this invention, the cassette 502 further has a holding means for holding the bottom plate 518 in the descended position when the front end portion of the bottom plate 518 is pushed downwardly against the resistance of the urging action of the spring 526.

In the illustrated embodiment, a substantially L-shaped plate spring 532 is fixed to the bottom surface of the front end portion of the bottom plate 518, and to the plate spring 532 is secured an anchor member 534 having a hook portion 534*a* at its free end. Since the anchor member 534 is secured to the bottom plate 518 through the plate spring 532, it can be displaced elastically in the longitudinal direction of the casing 506 with respect to the bottom plate 518. On the other hand, the bottom wall 508 of the cassette casing 506 has formed therein an opening 536 with which the hook portion 534*a* of the anchor member 534 can be engaged. Thus, when the front end portion of the bottom plate 518 is pushed downwardly in the state shown in FIG. 4-A, the hook portion 534*a* of the anchor member 534 engages the opening 536 to hold the bottom plate 518 in its descended position, as shown in FIG. 4-B.

Now, the cassette-receiving section 504 is described. The cassette-receiving section 504 is constructed of a cassette-receiving plate 538 fixed between the inner side plates 68*a* and 68*b* already described hereinabove, and a pair of guide members 540 fixed respectively to the inside surfaces of the inner side plates 68*a* and 68*b* above the cassette-receiving plate 538. The distance in the perpendicular direction between the cassette-receiving plate 538 and said pair of guide members 540 corresponds to the height of the cassette casing 506. When the cassette 502 is to be inserted into the cassette-receiving section 504, the bottom surface of the cassette casing 506 is positioned on the cassette-receiving plate 538, and the guide members 540 guide the top surface of the casing 506. On the other hand, in the illustrated embodiment, the width of the cassette casing 506 corresponds to the distance between the inner side plate 68*a* and 68*b* in the lateral direction. When the cassette 502 is to be inserted into the cassette-receiving section 504, a pair of the inner side plates 68*a* and 68*b* guide the two side surfaces of the cassette casing 506. An upstanding portion 541 extending upwardly in the perpendicular direction is formed at the front end of the cassette-receiving plate 538. When the cassette 502 is inserted into the cassette-receiving section 504, the front surface of the cassette casing 506 abuts the upstanding portion 541, thereby preventing further insertion of the cassette 502 into the cassette-receiving section 504. The cassette-receiving section 504 further includes a pair of paper feed rollers 54 secured to a support shaft 436 mounted rotatably between the inner side plates 68*a* and 68*b* as in the cassette-type paper feeding means illustrated in FIGS. 2-A to 2-C.

The aforesaid construction of the cassette-receiving section 504 is already known. The cassette-receiving section 504 further includes a releasing means for releasing the holding action of the holding means provided in the cassette 502 when the cassette 502 has been inserted into a predetermined position of the cassette-receiving section 504 (the position at which the front surface of the cassette casing 506 abuts the upstanding portion 541).

In the illustrated embodiment, a rectangular cut 542 is formed in the rear end portion of the cassette-receiving plate 538, and the bottom edge 544 of the cut 542 constitutes the releasing means (the operation of the bottom edge 544 will be described hereinbelow).

With reference to FIGS. 5-A and 5-B, the operation and advantage of the aforesaid cassette-type paper feeding means are described below.

In accommodating a plurality of sheet-like copying papers 528 in the stacked state in the cassette casing 506, the first step is to remove the closure plate 516 from the main body of the cassette casing 506. Then, the front end portion of the bottom plate 518 is pushed downward to bring the anchor member 534 into engagement with the opening 536 and thereby to hold the bottom plate in its descended position shown in FIG. 4-B. Subsequently, the copying papers 528 are placed on the bottom plate 518, and the closure plate 516 is mounted in position in the main body of the cassette casing 506. Thus, the cassette 502 assumes the state shown in FIG. 5-A. The cassette 502 in this state is inserted into the cassette-receiving section 504. During this inserting operation, the bottom plate is held at its descended position as shown in FIGS. 5-A, and therefore, the copying papers 528 placed on the bottom plate are also held at their descended position. Accordingly, the topmost paper of the stacked copying papers 528 is located below the bottom surfaces of the paper feed rollers 54. Thus, the paper feed rollers 54 do not contact the copying paper, and the movement of the topmost copying paper is not obstructed by the paper feed rollers 54. On the other hand, when the cassette 502 is inserted into a predetermined position of the cassette-receiving section 504 (i.e., the position at which the front surface of the cassette casing 506 abuts the upstanding portion 541), the bottom edge 544 of the cut 542 formed in the cassette-receiving plate 538 abuts the hook portion 534*a* of the anchor member 534 to displace the anchor member 534 toward the right in FIG. 5-A. As a result, the anchor member 534 comes out of the opening 536, and as shown in FIG. 5-B, the front end portion of the bottom plate 518 and the front end portion of the copying papers 528 placed on it are lifted by the urging action of the spring 526. When the front end portions of the bottom plate 518 and the copying papers 528 are lifted, a pair of the press members 530 engage the two side portions of the front end of the topmost copying paper of the stacked copying papers 528, and simultaneously, a pair of the paper feed rollers 54 engage the surface of the topmost copying paper 528 through the opening formed in the front end portion of the top surface of the cassette casing 506.

When the cassette 502 is removed from the cassette-receiving section 504 in the cassette-type paper feeding means described hereinabove with the casing 506 still containing copying papers 528, the cassette 502 is moved while the paper feed rollers 54 are in engagement with the surface of the topmost copying paper sheet 528. This brings about the problem that the topmost paper in the stacked copying papers 528 is displaced forwardly relative to the cassette casing 506. This problem, however, does not adversely affect the operation of the electrostatic copying paper, and is permissible unlike the problem which arises when the topmost copying paper 528 moves backward relative to the cassette casing when the cassette 502 is inserted into the cassette-receiving section 504.

Improvements in the cassette casing

The cassette casing used in the aforesaid copying paper cassette can be applied only to sheet-like copying papers of a single specified size. Cassette casings have already been suggested and put into practical use which are applicable to sheet-like copying papers having at least two different sizes.

In a known cassette casing which can be applied to sheet-like copying papers of at least two different sizes, a restricting plate for restricting the rear end of a sheet-like copying paper is mounted on the bottom wall of the main body of the cassette casing in such a manner that it can move freely along the longitudinal direction of the cassette casing (i.e., along the conveying direction of the sheet-like copying paper). The restricting plate is adapted to be moved to a predetermined position according to the size of sheet-like copying papers and be fixed there. Accordingly, every time copying papers of a different size are used, it is necessary to move the restricting plate and fix it. The operation is, therefore, troublesome. Moreover, the size of sheet-like copying papers accommodated in the cassette casing cannot be identified when the cassette casing is capped with a closure plate. It is necessary to open the closure plate in order to identify the paper size.

According to this invention, however, there is provided a cassette casing for sheet-like copying papers of at least two different sizes, which permits fixing of the rear end of sheet-like copying sheets in the cassette casing by a simple operation and enables the size of the sheet-like copying sheets to be identified from outside the casing.

One embodiment of the cassette casing provided by the present invention is described in detail below with reference to FIGS. 6 to 11.

Figure 6:
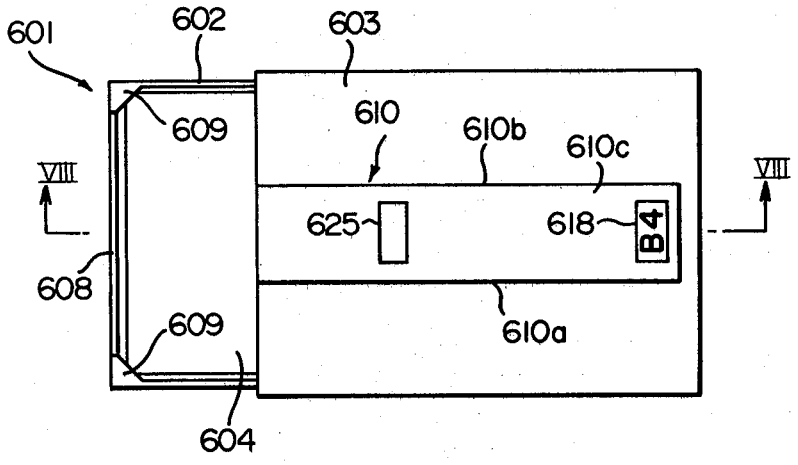
FIG. 6 is a top plan view of a cassette casing improved by this invention.
Figure 7:
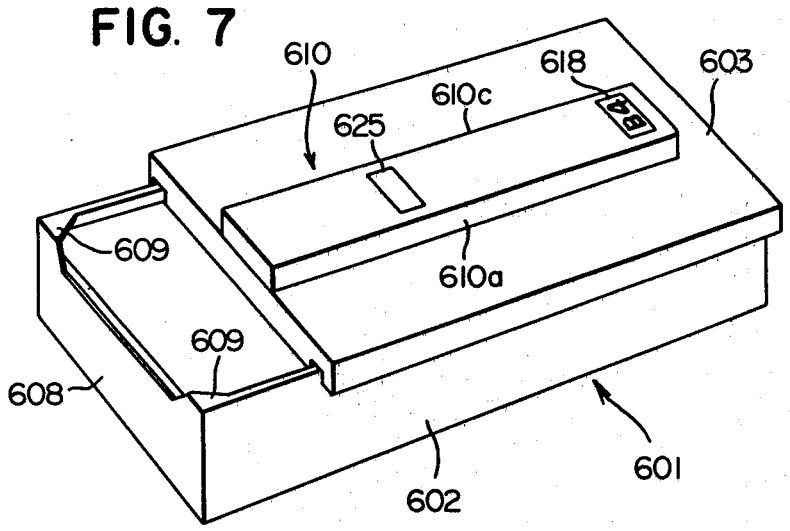
FIG. 7 is a perspective view of the cassette casing shown in FIG. 6.
Figure 8:
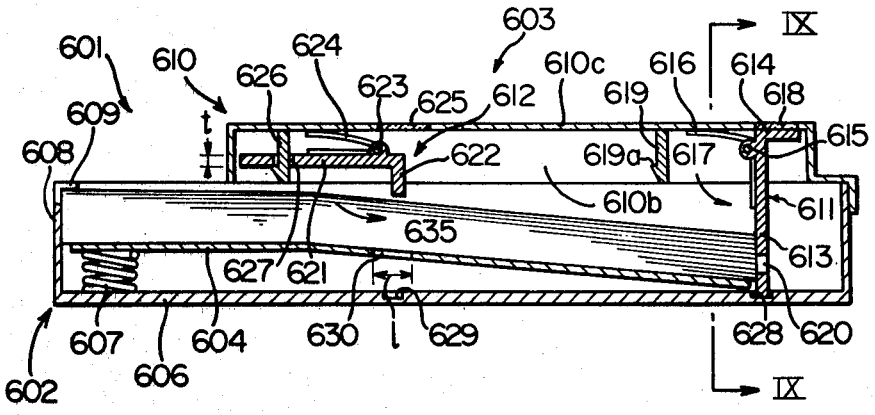
FIG. 8 is a sectional view taken along the line VIII—VIII of FIG. 6.

Referring to FIGS. 6, 7 and 8, the cassette casing 601 illustrated is constructed such that it can be applied to sheet-like copying papers of two different sizes, B4 and B5 according to JIS (Japanese Industrial Standards). The drawings show the accommodation of sheet-like copying papers with a B4 size in the cassette casing.

The cassette casing 601 includes a box-like housing 602 with an open top, and a closure plate 603 mounted removably on the top surface of the housing 602. A bottom plate 604 is disposed on the bottom wall of the housing 602, and a spring 607 for urging the front end portion of the bottom plate 604 upwardly is interposed between the bottom wall of the housing 602 and the bottom plate 604. Sheet-like copying papers in the stacked state are placed on the bottom plate 604. On both side portions of the front end of the top surface of the housing 602 are provided press members 609 with which both side portions of the front end of the copying papers come into abutment.

The aforesaid construction of the cassette casing 601 is already known. In the present invention, the casing 601 is improved in the following respect so that it can be applied to sheet-like copying papers of two different sizes, B5 and B4.

A protruded portion 610 projecting upwardly and extending in the longitudinal direction is formed centrally in the closure plate 603. A restricting member or sheet strap 611 for restricting the positions of the rear end of a copying paper of B4 size and displaying its size is provided within the protruded portion 610 at a position near its rear end in the longitudinal direction. A restricting member 612 for restricting the rear end of a copying paper of B5 size and displaying its size is provided ahead of the restricting member 611 in the longitudinal direction within the protruded portion 610.

Figure 9:
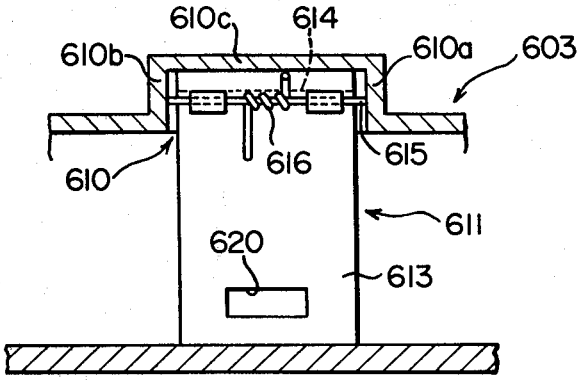
FIG. 9 is a sectional view taken along the line IX—IX of FIG. 8.

Referring to FIGS. 9, 10-A and 10-B, the restricting member 611 is formed in an L-shape and includes a restricting or sheet stop portion 613 for restricting the rear end of a copying paper of B4 size and a display portion 611 located substantially at right angles to the restricting portion 613 and having an indication of the size of the copying paper to be restricted. The connecting part between the restricting portion 613 and the display portion 614 is pivotably supported by a horizontal pin 615 provided at right angles to the longitudinal direction and extending between side walls 610*a* and 610*b* of the protruded portion 610. About the horizontal pin 615 is provided a torsion spring 616. One end of the torsion spring 616 abuts a top panel 610*c* of the protruded portion 610, and the other abuts the restricting member 613. Thus, the spring 616 urges the restricting member 611 about the horizontal pin 615 in the direction of an arrow 617. As clearly shown in FIG. 8, when the restricting portion 613 descends and the restricting member 611 is set at an operative position at which it restricts the rear end of copying paper, the display portion 614 abuts the top panel 610*c* of the protruded portion 610 to restrict the rotation of the restricting member 611 in the direction shown by an arrow 617. At that part of the top panel 610*c* with which the display portion 614 comes into abutment is formed a display window 618 made of a transparent or semitransparent material. When the display portion 614 is in contact with the display window 618, the indication "B4" attached to the display portion 614 can be viewed from above the closure plate 603.

Ahead of the horizontal pin 615, a downwardly extending engaging member 619 is secured to the top panel 610*c*. An engaging hole 620 is formed at that part of the restricting portion 613 which corresponds to the engaging member 619 when the restricting member 611 is rotated in a direction opposite to the direction of arrow 617 in resistance to the urging force of the torsion spring 616. For example, when copying papers of B5 size are to be accommodated in the cassette casing, the restricting member 611 is rotated in a direction opposite to the direction of arrow 617, and brought to its inoperative position at which the engaging hole 620 is held by the engaging portion 619*a* of the engaging member 619, whereby the restricting member 611 is set in the protruded portion 610.

The other restricting member 612 is of an L-shaped structure composed of a restricting portion 621 and a display portion 622, as in the restricting member 611. The connecting portion between the restricting portion 621 and the display portion 622 is supported pivotably by a horizontal pin 623 which lies parallel to the horizontal pin 615. The restricting member 612 is urged in the direction shown by an arrow 635 by a torsion spring 624, and ahead of the horizontal pin 623, an engaging member 626 similar to the engaging member 619 is fixed. A holding hole 627 is formed at that part of the restricting portion 621 which corresponds to the stop member 626. A display window 625 made of a transparent or semitransparent material is formed at that part of the top panel 610*c* with which the display portion 622 comes into abutment.

Referring to FIG. 11, a groove 628 is formed in the bottom wall 606 of the housing 602 of cassette casing 601 at a position which corresponds to the lower end of the restricting member 613 when the restricting member 611 is brought to an operative position. The restricting member 611 is held in the operative position by fitting the lower end part of the restricting portion 613 of the restricting member 611 into the groove 628, thus preventing the rearward displacement of the rear end of copying paper beyond the restricting portion 613. A groove 629 similar to the groove 628 is formed in the bottom wall 606 at that position which corresponds to the lower end portion of the restricting portion 621 of the restricting member 612. In the bottom plate 604, a hold 630 is formed at a position corresponding to the restricting portion 621 of the restricting member 612. The lower end portion of the restricting portion 621 extends through the hole 630 and is fitted into the groove 629. The length l of the hole 630 is made larger than the thickness t of the restricting portion 621 of the restricting member 612 in view of the fact that the bottom plate 604 is displaced up and down.

In accommodating sheet-like copying papers of B4 size, the engagement of the engaging portion 619*a* of the engaging member 619 with the engaging hole 620 of the restricting member 611 is released. As a result, the restricting member 611 is rotated from the state shown in FIG. 27-A in the direction of arrow 617 as shown in FIG. 10-B by the urging force of the spring 616, and the display portion 614 stops on abutment with the display window 618. In this state, the restricting portion 613 descends. When the closure plate 603 is mounted on the top surface of the housing 602, the lower end portion of the restricting portion 613 is fitted into the groove 628, and the rear end of copying papers of B4 size is restricted by the restricting portion 613. At this time, the indication "B4" marked in the display portion 614 in contact with the display window 618 can be viewed from above the closure plate 603 through the display window 618, and thus, the size of copying papers accommodated in the cassette casing 601 can be identified.

In accommodating sheet-like copying papers of B5 size in the cassette casing 601, the restricting member 611 is rotated in a direction opposite to the direction of arrow 617 in resistance to the urging force of the spring 616 to engage the engaging hole 620 with the member 619. When the engagement of the member 626 with the engaging hole 627 of the restricting member 612 is subsequently released, the restricting member 612 is rotated in a direction of an arrow 635 by the urging force of the spring 624 to cause the restricting portion 621 to descend. When the closure plate 603 is mounted on the housing 602, the lower end portion of the restricting portion 621 extends through the hole 630 and is fitted in the groove 629. Since the display portion 622 at this time can be viewed from above the closure plate 603 through the display window 625, it is possible to ascertain that the copying papers with B5 size are placed in the cassette casing.

If desired, in the cassette casing 601 described above, the restricting portions 613 and 621 may be made of a magnetic material, and magnets can be secured instead of the engaging members 619 and 626 to the top panel 610*c*. Moreover, the display windows 618 and 625 may be constructed of simple openings formed in the top panel 610*c* of the protruded portion 610 instead of using a transparent or semitransparent material to make them. Alternatively, the entire top panel 610*c* or closure plate 603 may be formed of a transparent or semitransparent material to form one large display window in place of the two display windows 618 and 625. Furthermore, in order that the cassette casing 601 may be applied to the cassette-type paper feed means described hereinabove, the improvements made in the cassette casing 106 illustrated in FIGS. 2-A to 2-C or the improvements made in the cassette casing 506 shown in FIGS. 3-A to 3-B may be applied to the cassette casing 601.

What we claim is:

1. A cassette casing for a stack of sheet-like copying papers of at least two different sizes, said casing comprising: a rectangular box-like housing having a longitudinal axis and an open top; a closure plate detachably mounted on the top of said housing and having at least one display window therein; and at least two sheet stop members mounted on the under side of said closure plate in spaced apart relation in the direction of the longitudinal axis of said cassette casing for pivotal movement about an axis extending transversely to said longitudinal axis, each of said sheet stop members having a sheet stop portion which, when said sheet stop member is pivoted to a sheet restricting position extends downwardly into said housing for restricting the position of the rear end of copying papers accommodated in said housing, and a display portion having an indication of the size of copying papers thus restricted, said display portion being positioned adjacent said display window when said sheet stop portion is pivoted to its sheet restricting position.

2. The cassette casing as claimed in claim 1 wherein said closure plate has at least two display windows corresponding to said sheet stop members.

3. The cassette casing as claimed in claim 2 wherein each of said sheet stop members is substantially L-shaped, and said sheet stop portion and said display portion extend at right angles to each other.

4. The cassette casing as claimed in any one of claims 1 to 34 which further includes means for holding each said sheet stop member in said operative position, and means for holding each said sheet stop member in the inoperative position at which the sheet stop portion is positioned adjacent to said closure plate.

5. The cassette casing as claimed in claim 1 further including elastic means for urging each said sheet stop member to said sheet restricting position.

* * * * *